US008840434B2

(12) United States Patent
Blakborn

(10) Patent No.: US 8,840,434 B2
(45) Date of Patent: Sep. 23, 2014

(54) ROTATABLE PLUG-TYPE CONNECTOR

(75) Inventor: Willem Blakborn, Inzell (DE)

(73) Assignee: Rosenberger Hochfrequenztechnik GmbH & Co., KG, Fridolfing (DE)

( * ) Notice: Subject to any disclaimer, the term of this patent is extended or adjusted under 35 U.S.C. 154(b) by 88 days.

(21) Appl. No.: 13/807,536

(22) PCT Filed: May 23, 2011

(86) PCT No.: PCT/EP2011/002558

§ 371 (c)(1),
(2), (4) Date: Feb. 2, 2013

(87) PCT Pub. No.: WO2012/000588

PCT Pub. Date: Jan. 5, 2012

(65) Prior Publication Data

US 2013/0122753 A1 May 16, 2013

(30) Foreign Application Priority Data

Jul. 2, 2010 (DE) ..... 20 2010 009 766 U

(51) Int. Cl.

| | |
|---|---|
| ***H01R 24/04*** | (2006.01) |
| ***H01R 13/516*** | (2006.01) |
| ***H01R 24/58*** | (2011.01) |
| ***H01R 9/03*** | (2006.01) |
| *H01R 103/00* | (2006.01) |
| *H01R 13/502* | (2006.01) |
| *H01R 24/38* | (2011.01) |

(52) U.S. Cl.

CPC ..... *H01R 13/516* (2013.01); *H01R 2103/00* (2013.01); *H01R 13/502* (2013.01); *H01R 24/38* (2013.01); *H01R 24/58* (2013.01); *H01R 9/032* (2013.01)

USPC ..... 439/669

(58) Field of Classification Search

USPC ..... 439/669, 668

See application file for complete search history.

(56) References Cited

U.S. PATENT DOCUMENTS

| | | | | |
|---|---|---|---|---|
| 3,246,282 | A | 4/1966 | Mas | |
| 6,641,442 | B1 | 11/2003 | Seminara | |
| 7,618,294 | B1 * | 11/2009 | Lin et al. | 439/669 |
| 8,206,181 | B2 * | 6/2012 | Steijner | 439/669 |

FOREIGN PATENT DOCUMENTS

| | | | |
|---|---|---|---|
| EP | 0067727 | A1 | 12/1982 |
| WO | 2008060470 | A2 | 5/2008 |

* cited by examiner

*Primary Examiner* — Gary Paumen

(74) *Attorney, Agent, or Firm* — DeLio, Peterson & Curcio, LLC; Robert Curcio

(57) ABSTRACT

A plug-type connector for transmitting electric currents, having a plug-side end forming a plug connection with a mating plug, a cable-side end electrically and mechanically connected to a cable with a screen and at least two lines within the screen, a housing, and at least two internal conductor parts which are held at least partially within the housing by an insulating part and are electrically insulated from one another, wherein the internal conductor parts project beyond the housing in the axial direction at the plug-side end, wherein the internal conductor parts form contact areas at the plug-side end in the region in which they project beyond the housing, the contact areas being spaced apart from one another in the axial direction and making electrical contact with corresponding conductor parts in the mating plug.

29 Claims, 2 Drawing Sheets

ROTATABLE PLUG-TYPE CONNECTOR

BACKGROUND OF THE INVENTION

1. Field of the Invention

The present invention relates to a plug-type connector for transmitting electric currents, having a plug-side end which is designed to form a plug connection with a mating plug, a cable-side end which is designed to be electrically and mechanically connected to a cable, in particular a cable with a screen and at least two conductors within the screen, a housing, and having at least two internal conductor parts which are held at least partially within the housing by an insulating part and which are electrically insulated from one another, and respective contact areas serving to make electrical contact with corresponding conductor parts in the mating plug, wherein each internal conductor part has a contact section which extends in an axial direction from the contact area in the direction of the cable-side end of the plug-type connector and is designed to be electrically and mechanically connected with a conductor of the cable.

2. Description of Related Art

Bipolar or multipolar plug-type connectors for electrical plugged connections require a precise alignment of plug and mating plug in order for the respective conductor of the plug-type connector to make electrical and mechanical contact with the correct conductor of the mating plug. The plug-type connector and mating connector are hereby not freely rotatable relative to one another. However, in some applications, after a plug-type connector arranged on the end of a cable has been plugged together with a mating connector which is, for example, fixed to a housing, a movement of the cable occurs, or the plug-type connector has to be rotated together with the cable in order for it to be plugged into the mating connector with the correct polarity. This leads to undesired mechanical tension forces in the plug-type connector and in the cable, which can for example lead to a screen of the cable being damaged, thus interfering with an electromagnetic screening of the plugged connection.

In order to establish multipolar plugged connections wherein the plug and mating plug are freely rotatable relative to one another, a multipolar jack plug is for example known from DD 236420 A1. A circumferential groove is hereby formed in the jack plug into which a contact spring arranged in a mating connector snaps, creating a corresponding contact force, as well as locking the jack plug in the mating connector. The contact spring is thereby one of the conductors in the mating connector and the groove is formed in one of the contact surfaces of the jack plug. Advantages of this jack plug connection are simple handling combined with space-saving construction design. Disadvantages are above all the short-circuiting plugging operation and the relatively poor contact quality. If the spring tension in the contact spring in the mating connector diminishes over time then not only does the electrical contact become poorer, the mechanical stability of the plugged connection is also impaired. The lack of mechanical locking can be a disadvantage in individual cases if accidental disconnection of the plugged connection can lead to damage, for example in the case of the loudspeaker connection of a tube guitar amplifier.

The contact load of a jack plug connection is, for example, up to 3 A for 6.35 mm sockets and couplings, the switching load 0.5 A at 50 V. Jack plugs are not therefore suitable for the transmission of high electric currents with currents of, for example, 20 A or more at high electric voltages of 100 V or more.

EP 0 067 727 A1 discloses a cable termination apparatus used to connect a double coaxial cable with a plug-type connector. This cable termination apparatus has two inner conductor parts which are held within a housing and electrically insulated from one another by means of an insulating part.

U.S. Pat. No. 6,641,442 B1 discloses a plug-type connector for a gas generator of an airbag, wherein a plug section is formed by a housing. An inner conductor contact is arranged within the plug section and a C-formed outer conductor contact is arranged radially on the plug section.

WO 2008/060470 A2 discloses a multiple-signal plug-type connector with a single contact. The single contact has two conductors electrically isolated from one another which provide two separate electrical contact surfaces. This allows two different electrical signals to be transmitted simultaneously via the single contact.

U.S. Pat. No. 3,246,282 discloses an electrical plug-type connector in the form of a jack socket. A tube-formed element is arranged in a sleeve which carries electrical connectors made of a resilient material. Conductor wires are passed to the electrical connectors via grooves on the external circumference of the sleeve. A jack plug plugged into the jack socket and making electrical contact with the electrical connectors can be rotated freely relative to the jack socket.

BRIEF SUMMARY OF THE INVENTION

The invention is based on the problem of providing a plug-type connector of the aforementioned type which is freely rotatable relative to a mating connector and at the same time permits the transmission of high currents.

This problem is solved according to the invention through a plug-type connector of the aforementioned type with the features identified in the claims.

The above and other objects, which will be apparent to those skilled in the art, are achieved in the present invention which is directed to a plug-type connector for transmitting electric currents, comprising a plug-side end forming a plug connection with a mating plug, a cable-side end electrically and mechanically connected to a cable with a screen and at least two conductors within the screen, a housing, and at least two internal conductor parts held at least partially within the housing by an insulating part and electrically insulated from one another, said internal conductor parts including contact areas serving to make electrical contact with corresponding conductor parts in the mating plug, wherein each internal conductor part has a contact section extending in an axial direction from the contact area in the direction of the cable-side end of the plug-type connector electrically and mechanically connected with a conductor of the cable, such that the internal conductor parts project beyond the housing in the axial direction at the plug-side end, wherein the internal conductor parts are spaced apart from one another in the axial direction, and form contact areas in the region in which they project beyond the housing at the plug-side end, serving to make electrical contact with corresponding conductor parts in the mating plug, wherein the contact areas of at least one first internal conductor part is in the form of a first hollow cylindrical contact surface interrupted in a circumferential direction by a gap, wherein the contact section of at least a second internal conductor part protrudes through the gap in the first hollow cylindrical contact surface in an axial direction, being electrically insulated from the first hollow cylindrical contact surface, so that the contact area of the second internal conductor part is arranged closer to the plug-side end of the plug-type connector, in an axial direction, than the contact area of the first internal conductor part.

The housing forms an electromagnetic screen and is formed on a cable-side end of the plug-type connector for electrical and mechanical connection with a screen of the cable. The contact area of at least one second internal conductor part is formed as a second hollow cylindrical contact surface, interrupted in a circumferential direction by a gap as a straight hollow circular cylinder. The contact areas and contact sections of the internal conductor parts are arranged in space on a surface defined by a generated surface of a straight circular cylinder.

An electrically insulating cover may be included, electrically insulating a section of the contact section of the second internal conductor part which projects through the gap against the outside in a radial direction. The cover may be integral with the insulating part. The insulating part may possess circumferential recesses spaced apart in an axial direction to receive the hollow cylindrical contact surface of the internal conductor parts. The insulating part may form an end face of the plug-side end of the plug-type connector. The insulating part may include two parts, a first part arranged radially within the internal conductor parts and a second part arranged radially outside of the internal conductor parts and radially within the housing.

The cover may be formed integrally with the second part of the insulating part.

The first part of the insulating part may form the end face of the plug-side end of the plug-type connector. The first hollow cylindrical contact surface of the first internal conductor part may comprise a straight hollow circular cylinder.

The plug-type connector may include a latching device for mechanical latching of the plug-type connector into the mating connector managed on an outer side of the housing. The latching device may include a groove running in a circumferential direction on an outer side of the housing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

Figure 1:
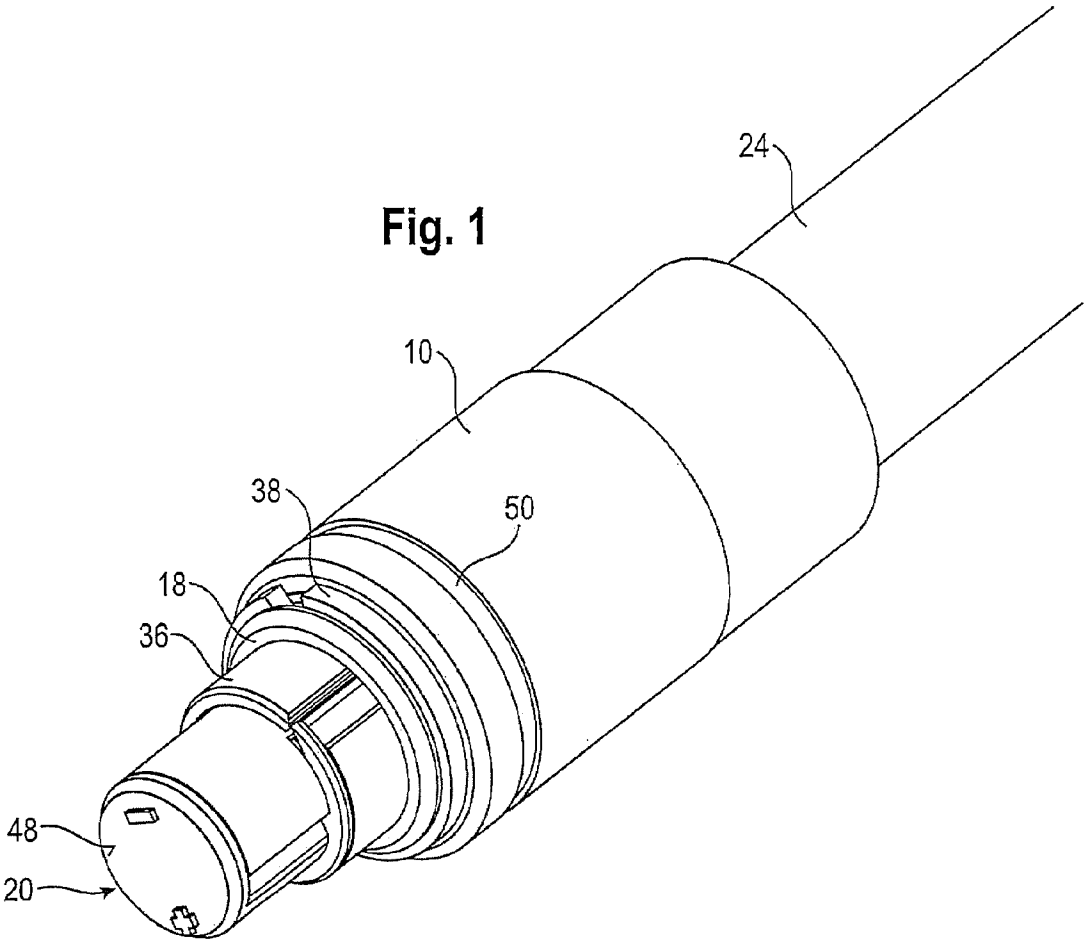
FIG. 1 shows a perspective view of a preferred embodiment of a plug-type connector in accordance with the invention.

According to the invention, in a plug-type connector of the aforementioned type, the internal conductor parts project beyond the housing at the plug-side end in an axial direction, the internal conductor parts being arranged and designed in such a way that, spaced apart from one another in the axial direction, in the region in which they project beyond the housing at the plug-side end, they form the contact areas serving to make electrical contact with corresponding conductor parts in the mating plug, wherein the contact area of at least one first internal conductor part is in the form of a first hollow cylindrical contact surface interrupted in a circumferential direction by a gap, wherein the contact section of at least a second internal conductor part is designed and arranged in such a way that this protrudes through the gap in the first hollow cylindrical contact surface in an axial direction, being electrically insulated from the first hollow cylindrical contact surface, so that the contact area of the second internal conductor part is arranged closer to the plug-side end of the plug-type connector, in an axial direction, than the contact area of the first internal conductor part.

This has the advantage that, when plugged together with a mating connector, the plug-type connector is freely rotatable in relation to this mating connector, so that mechanical stresses in the plug-type connector and the cable connected with this are effectively avoided in the plugged-in state, and at the same time high electric currents of, for example, 20 amperes or more can be transmitted in a functionally reliable manner via this plug-type connector. In addition, a mechanical locking of the plug-type connector in the mating connector with high retaining forces can be realized simply and in a functionally reliable manner via the internal conductor parts, since these are held by the insulating part so as to be resistant to mechanical stress in an axial direction. The open hollow cylinder of the contact area allows simple assembly by fitting the internal conductor part onto the insulating part in a radial direction. This makes possible an automated manufacture of the connection of the plug-type connector and cable by machine.

A continuation of an electromagnetic screen from the cable into the plug-type connector is achieved in that the housing forms an electromagnetic screen and is formed on a cable-side end of the plug-type connector for electrical and mechanical connection with a screen of the cable.

A particularly simple manufacture and assembly of the plug-type connector is achieved in that the contact area of at least one second internal conductor part is formed as a second hollow cylindrical contact surface, in particular as a second hollow cylindrical contact surface interrupted in a circumferential direction by a gap, in particular as a straight hollow circular cylinder.

Particularly good electrical transmission properties of the plug-type connector are achieved in that the contact areas and contact sections of the internal conductor parts are designed and arranged in such a way that these are arranged in space on a surface defined by a generated surface of a straight circular cylinder.

An electrical insulation of the internal conductor parts against undesired short circuit when plugged together with a mating connector, even where the mating connector is of very simple structure, is achieved in that an electrically insulating cover is arranged and designed in such a way that this cover electrically insulates a section of the contact section of the second internal conductor part which projects through the gap against the outside in a radial direction.

A particularly simple manufacture and assembly of the plug-type connector with few individual components is achieved in that the cover is formed integrally on the insulating part.

A simple assembly of the plug-type connector with simultaneous axial fixing of the internal conductor parts is achieved in that the insulating part possesses circumferential recesses spaced apart in an axial direction to receive the hollow cylindrical contact surface of the internal conductor parts.

An electrically neutral stop in an axial direction for the plug-type connector in the mating connector is achieved in that the insulating part forms an end face of the plug-side end of the plug-type connector.

A functionally reliable holding of the internal conductor parts and at the same time an electrical insulation of the internal conductor parts relative to the housing is achieved in that the insulating part is designed in two parts, wherein a first part of the insulating part is arranged radially within the internal conductor parts and a second part of the insulating part is arranged radially outside of the internal conductor parts and radially within the housing.

An arrangement of the cover such that the second internal conductor part is automatically insulated electrically from a contact in the mating connector for the first internal conductor part through the arrangement of the parts of the insulating part is achieved in that the cover is formed integrally with the second part of the insulating part.

A particularly simple structure of the plug-type connector is achieved in that the first part of the insulating part forms the end face of the plug-side end of the plug-type connector.

A radially symmetrical form of the plug-side end of the plug-type connector allowing simple rotation relative to the mating connector in the plugged-in state is achieved in that the first hollow cylindrical contact surface of the first internal conductor part is designed as a straight hollow circular cylinder.

A release of the mechanical locking of the plugged connection from the state of electrical contact is achieved in that a latching device for mechanical latching of the plug-type connector into the mating connector is arranged on an outer side of the housing. This latching device is for example in the form of a groove running in a circumferential direction on an outer side of the housing.

Figure 2:
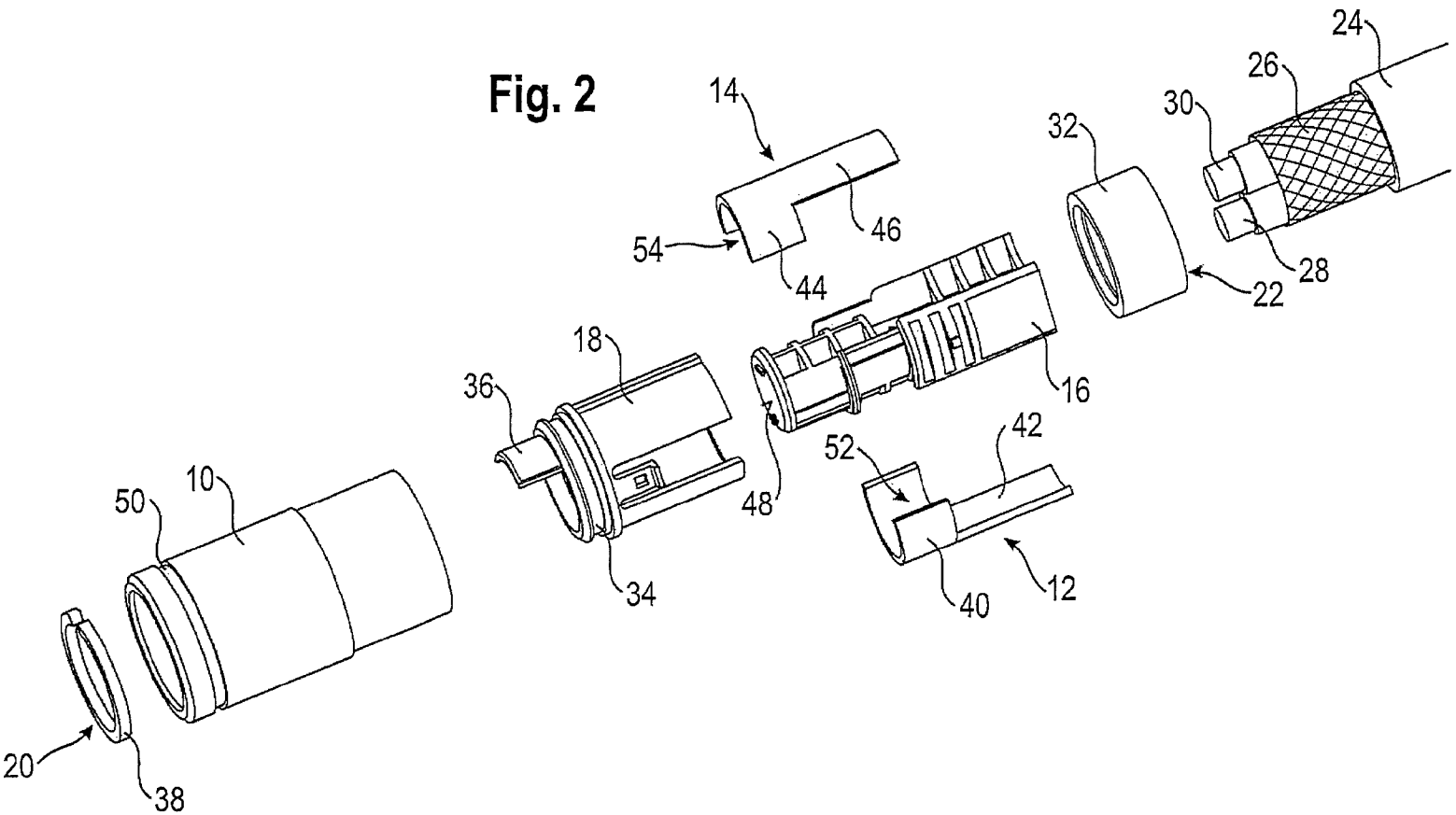
FIG. 2 shows an exploded view of the preferred embodiment of a plug-type connector in accordance with the invention as shown in FIG. 1.

The preferred embodiment of a plug-type connector in accordance with the invention for transmitting electric currents shown in FIGS. 1 and 2 comprises a housing 10, a first internal conductor part 12, a second internal conductor part 14, a first part 16 of an insulating part, which holds the internal conductor parts 12, 14 radially within the housing 10 in a predetermined position, a second part 18 of the insulating part which is arranged radially between the internal conductor parts 12, 14 and the housing 10, a plug-side end 20 which is designed to be plugged together with a mating plug, so that plug-type connector and mating plug are electrically and mechanically connected, and a cable-side end 22, designed for electrical and mechanical connection with a cable 24 which possesses a screen 26 in the form of an external conductor braid, a first conductor 28 and a second conductor 30. The housing 10 is manufactured from an electrically conductive material and can be electrically and mechanically connected on the cable-side end 22 with the external conductor braid 26, so that the housing 10 forms an electromagnetic screen for the plug-type connector. A support sleeve 32 is provided for electrical and mechanical connection of the cable-side end 22 of the plug-type connector. The two parts 16, 18 of the insulating part are so designed that these can be plugged into the housing 10 in an axial direction. The second part 18 of the insulating part has a section with a circumferential groove 34 and a cover 36 which projects beyond the housing 10 in an axial direction and in the direction of the plug-side end of the plug-type connector. A split securing ring 38 can be arranged in this groove 34 which fixes the housing 10 in an axial direction on the plug-side end 20. On the cable-side end 22, the housing 10 is fixed axially through the support sleeve 32.

The first internal conductor part 12 possesses a first contact area 40 designed to make electrical and mechanical contact with a corresponding contact in the mating connector as well as a first contact section 42 extending in an axial direction from the first contact area 40 in the direction of the cable-side end 22 of the plug-type connector which is designed for electrical and mechanical connection with the first conductor 28 of the cable 24. The second internal conductor part 14 possesses a second contact area 44 designed to make electrical and mechanical contact with a corresponding contact in the mating connector as well as a second contact section 46 extending in an axial direction from the second contact area 44 in the direction of the cable-side end 22 of the plug-type connector which is designed for electrical and mechanical connection with the second conductor 30 of the cable 24.

The first part 16 of the insulating part forms an end face 48 on the plug-side end 20 of the plug-type connector.

A circumferential groove 50 is formed on an outer wall of the housing 10. This can serve as a latching device for a corresponding locking or latching mechanism on the mating connector in order to mechanically lock or latch the plug-type connector and the mating connector in a plugged-together state against being accidentally pulled apart in an axial direction.

The first and second contact areas 40, 44 of the internal conductor parts 12, 14 are, respectively, designed as first and second hollow cylindrical contact surfaces interrupted in a circumferential direction by a gap 52, 54, so that the contact areas 40, 44 are substantially annular in structure, with an open side or gap 52, 54. The hollow cylinders 40, 44 are thereby designed as straight hollow circular cylinders. The arrangement of the internal conductor parts 12, 14 is chosen such that the second contact section 46 of the second internal conductor part 14 projects through the gap 52 of the first internal conductor part 12. The arrangement is thereby such that an imaginary completion of the first hollow cylinder 40, which is interrupted in a circumferential direction, in the region of the gap 52 to form a complete hollow cylinder or ring at least intersects with the second contact section 46 of the second internal conductor part 14. In the illustrated embodiment, the second contact section 46 of the second internal conductor part 14 is located on a generated surface of a straight circular cylinder which is held by the first hollow cylinder 40 of the first internal conductor part 12. The second contact section 46 of the second internal conductor part 14 is passed through the gap 52 in the first hollow cylindrical contact surface 40 of the first internal conductor part 12 in such a way that an electrical contact between these two components is prevented. Through a corresponding distance between the second contact section 46 of the second internal conductor part 14 and the first hollow cylindrical contact surface 40 of the first internal conductor part 12, also in the region of the gap 52, the first and second internal conductor parts 12, 14 remain electrically insulated from one another.

The first part 16 of the insulating part has corresponding recesses to accommodate the hollow cylindrical contact surfaces 40, 44 of the internal conductor parts 12, 14. These can simply be pushed or plugged onto the first part 16 of the insulating part radially from the outside through the gap or open side 52, 54 of the hollow cylindrical contact surfaces 40, 44 of the internal conductor parts 12, 14. Through a corresponding resilient design of the internal conductor parts 12, 14, when being plugged radially onto the first part 16 of the insulating part the hollow cylindrical contact surfaces 40, 44 are widened slightly in a radial direction and clip onto the first part 16 of the insulating part, in that these snap back into their basic position under the action of a spring-elastic force. The contact areas or the hollow cylindrical contact surfaces 40, 44 are arranged on the first part 16 of the insulating part at a distance from one another in an axial direction. This section of the first part 16 of the insulating part with the contact areas 40, 44 projects beyond the housing 10 in an axial direction, as can be seen from FIG. 1, so that these contact areas 40, 44 on the plug-side end 20 of the plug-type connector are exposed, allowing electrical and mechanical contact with corresponding contacts in the mating connector. The resulting geometry on the plug-side end 20 means that, when plugged together with the mating plug, the plug-type connector can be rotated freely in relation to the mating connector. For example, a contact in the mating connector hereby contacts the first contact area 40 radially from the outside. In order to prevent this contact in the mating connector at the same time also making contact with the second internal conductor 14 in the region where the contact section 46 is passed through the gap 52, the cover 36 is provided, which electrically insulates this section of the contact section 46 in the region of the gap 52 radially from the outside. This means that the corresponding contact in the mating connector for the first contact area 40 can be designed to be completely continuous in a circumferential direction, without the second internal conductor 14 thereby also coming into electrical and mechanical contact with this contact in the mating connector in an undesired manner.

In order to fit the cable-side end 22 of the plug-type connector to the cable 24, this is stripped so that the external conductor braid 26 as well as the conductor 28, 30 are exposed. The support sleeve 32 is pushed over the cable 24 and the external conductor braid 26 is laid over this. If necessary the support sleeve 32 is crimped onto the cable 24. The internal conductor parts 12, 14 are each connected electrically and mechanically with the conductors 28, 30, for example by means of soldering or welding. These internal conductor parts 12, 14 connected in this way with the conductors 28, 30 are plugged or clipped onto the first part 16 of the insulating part radially from the outside. Corresponding receiving recesses in the first part 16 of the insulating part for the contact areas 40, 44 insulate them from one another electrically in an axial direction. The second part 18 of the insulating part is then pushed axially onto the first part 16 of the insulating part. This results in the free region of the second contact section 46 in the gap 52 being electrically insulated in a radial direction from the outside by the cover 36. At the same time the second part 18 of the insulating part fixes the internal conductor parts 12, 14 in a radial direction and insulates the internal conductor parts 12, 14, in an outwards radial direction, from the housing 10 which is fitted later. A corresponding latching mechanism fixes the second part 18 of the insulating part to the first part 16 of the insulating part in an axial direction. The housing 10 is then pushed in an axial direction over the second part 18 of the insulating part until it runs up against the support sleeve 32. The housing 10 which, like the support sleeve 32, is manufactured of an electrically conductive material, is connected electrically and mechanically with the outer conductor braid 26 of the cable 24 via the support sleeve 32. The securing ring 38 is arranged in the groove 34, so that the housing 10 is fixed in an axial direction and secured against being pulled off in the direction of the plug-side end. The plug-type connector in accordance with the invention is now completely assembled and connected electrically and mechanically with the cable 24.

While the present invention has been particularly described, in conjunction with the specific preferred embodiment(s), it is evident that many alternatives, modifications, and variations will be apparent to those skilled in the art, in light of the foregoing description. It is therefore contemplated that the appended claims will embrace any such alternatives, modifications, and variations as falling within the true scope and spirit of the present invention.

Thus, having described the invention, what is claimed is:

1. A plug-type connector for transmitting electric currents, comprising a plug-side end forming a plug connection with a mating plug, a cable-side end electrically and mechanically connected to a cable with a screen and at least two conductors within the screen, a housing, and at least two internal conductor parts held at least partially within the housing by an insulating part and electrically insulated from one another, said internal conductor parts including contact areas serving to make electrical contact with corresponding conductor parts in the mating plug, wherein each internal conductor part has a contact section extending in an axial direction from the contact area in the direction of the cable-side end of the plug-type connector electrically and mechanically connected with a conductor of the cable, such that the internal conductor parts project beyond the housing in the axial direction at the plug-side end, wherein the internal conductor parts are spaced apart from one another in the axial direction, and form contact areas in the region in which they project beyond the housing at the plug-side end, serving to make electrical contact with corresponding conductor parts in the mating plug, wherein the contact areas of at least one first internal conductor part is in the form of a first hollow cylindrical contact surface interrupted in a circumferential direction by a gap, wherein the contact section of at least a second internal conductor part protrudes through the gap in the first hollow cylindrical contact surface in an axial direction, being electrically insulated from the first hollow cylindrical contact surface, so that the contact area of the second internal conductor part is arranged closer to the plug-side end of the plug-type connector, in an axial direction, than the contact area of the first internal conductor part.

2. The plug-type connector of claim 1 wherein the housing forms an electromagnetic screen and is formed on a cable-side end of the plug-type connector for electrical and mechanical connection with a screen of the cable.

3. The plug-type connector of claim 1 wherein the contact area of at least one second internal conductor part is formed as a second hollow cylindrical contact surface, interrupted in a circumferential direction by a gap as a straight hollow circular cylinder.

4. The plug-type connector of claim 1, wherein the contact areas and contact sections of the internal conductor parts are arranged in space on a surface defined by a generated surface of a straight circular cylinder.

5. The plug-type connector of claim 1 including an electrically insulating cover electrically insulating a section of the contact section of the second internal conductor part which projects through the gap against the outside in a radial direction.

6. The plug-type connector of claim 5 wherein the cover is integral with the insulating part.

7. The plug-type connector of claim 1 wherein the insulating part possesses circumferential recesses spaced apart in an axial direction to receive the hollow cylindrical contact surface of the internal conductor parts.

8. The plug-type connector of claim 1 wherein the insulating part forms an end face of the plug-side end of the plug-type connector.

9. The plug-type connector of claim 1, wherein the insulating part includes two parts, a first part arranged radially within the internal conductor parts and a second part arranged radially outside of the internal conductor parts and radially within the housing.

10. The plug-type connector of claim 6, wherein the cover is formed integrally with the second part of the insulating part.

11. The plug-type connector of claim 8, wherein the first part of the insulating part forms the end face of the plug-side end of the plug-type connector.

12. The plug-type connector of claim 1, wherein the first hollow cylindrical contact surface of the first internal conductor part comprises a straight hollow circular cylinder.

13. The plug-type connector of claim 1 including a latching device for mechanical latching of the plug-type connector into the mating connector arranged on an outer side of the housing.

14. The plug-type connector of claim 13, wherein the latching device comprises a groove running in a circumferential direction on an outer side of the housing.

15. The plug-type connector of claim 2 wherein the contact area of at least one second internal conductor part is formed as a second hollow cylindrical contact surface, interrupted in a circumferential direction by a gap, as a straight hollow circular cylinder.

16. The plug-type connector of claim 2, wherein the contact areas and contact sections of the internal conductor parts are arranged in space on a surface defined by a generated surface of a straight circular cylinder.

17. The plug-type connector of claim 15, wherein the contact areas and contact sections of the internal conductor parts are arranged in space on a surface defined by a generated surface of a straight circular cylinder.

18. The plug-type connector of claim 4 including an electrically insulating cover electrically insulating a section of the contact section of the second internal conductor part which projects through the gap against the outside in a radial direction.

19. The plug-type connector of claim 18 wherein the cover is integral with the insulating part.

20. The plug-type connector of claim 6 wherein the insulating part possesses circumferential recesses spaced apart in an axial direction to receive the hollow cylindrical contact surface of the internal conductor parts.

21. The plug-type connector of claim 18 wherein the insulating part possesses circumferential recesses spaced apart in an axial direction to receive the hollow cylindrical contact surface of the internal conductor parts.

22. The plug-type connector of claim 21 wherein the insulating part forms an end face of the plug-side end of the plug-type connector.

23. The plug-type connector of claim 17, wherein the insulating part includes two parts, a first part arranged radially within the internal conductor parts and a second part arranged radially outside of the internal conductor parts and radially within the housing.

24. The plug-type connector of claim 9, wherein the cover is formed integrally with the second part of the insulating part.

25. The plug-type connector of claim 9, wherein the first part of the insulating part forms the end face of the plug-side end of the plug-type connector.

26. The plug-type connector of claim 10, wherein the first part of the insulating part forms the end face of the plug-side end of the plug-type connector.

27. The plug-type connector of claim 4, wherein the first hollow cylindrical contact surface of the first internal conductor part comprises a straight hollow circular cylinder.

28. The plug-type connector of claim 23 including a latching device for mechanical latching of the plug-type connector into the mating connector arranged on an outer side of the housing.

29. The plug-type connector of claim 28, wherein the latching device comprises a groove running in a circumferential direction on an outer side of the housing.

* * * * *